US006933817B2

(12) United States Patent
Reeves

(10) Patent No.: US 6,933,817 B2
(45) Date of Patent: Aug. 23, 2005

(54) SUPPORT MEMBER FOR A SUPERCONDUCTING MAGNET ASSEMBLY

(75) Inventor: David George Reeves, Bloxham (GB)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 55 days.

(21) Appl. No.: 10/707,073

(22) Filed: Nov. 19, 2003

(65) Prior Publication Data

US 2004/0108925 A1 Jun. 10, 2004

(30) Foreign Application Priority Data

Dec. 10, 2002 (GB) ..... 0228780

(51) Int. Cl.[7] ..... H01F 6/00; F25B 19/00
(52) U.S. Cl. ..... 335/216; 62/51.1
(58) Field of Search ..... 335/216; 324/318–320; 62/51.1

(56) References Cited

U.S. PATENT DOCUMENTS 3,102,655 A 9/1963 Adkins et al. ..... 220/15
4,599,592 A * 7/1986 Marsing ..... 335/216
4,837,541 A * 6/1989 Pelc ..... 335/300
4,853,661 A * 8/1989 Palkovich ..... 335/216
5,115,219 A * 5/1992 Withers et al. ..... 335/216
5,651,256 A 7/1997 Herd et al. ..... 62/51.1

FOREIGN PATENT DOCUMENTS

DE 4323510 5/1995 ..... F16S/3/00
EP 0 414 443 2/1991 ..... H01F/7/22

* cited by examiner

*Primary Examiner*—Ramon M. Barrera
(74) *Attorney, Agent, or Firm*—Cantor Colburn LLP

(57) ABSTRACT

A superconducting magnet assembly is described wherein the magnet cartridge is suspended within the vacuum chamber by a single support member extending from a wall of the vacuum chamber to the magnet cartridge. In one aspect, the support member includes a support tube and a joint attached to an end of the support tube. The joint is attached to the wall of the outer vacuum chamber, and provides at least one degree of freedom to the support tube relative to the wall. In another aspect, a joint is attached to an opposite end of the support tube, and is attached to the magnet cartridge for providing at least one degree of freedom to the support tube relative to the magnet cartridge. In another aspect, the support is constructed from one or more sections and the material choice is governed by the requirements for strength, stiffness, and thermal conductivity.

25 Claims, 5 Drawing Sheets

SUPPORT MEMBER FOR A SUPERCONDUCTING MAGNET ASSEMBLY

CROSS REFERENCE TO RELATED APPLICATIONS

This application claims the benefit of a priority under 35 U.S.C. 119 to Great Britain Patent Application No. 0228780.3 filed Dec. 10, 2002, the entire contents of which are hereby incorporated by reference.

BACKGROUND OF INVENTION

This invention relates to support members for superconducting magnet assemblies. More particularly, the invention relates to a support member for suspending a magnet cartridge within a vacuum chamber in a superconductor magnet assembly.

Superconducting magnets typically include a magnet cartridge suspended within an outer vacuum chamber by a plurality of support members, which extend from the outer vacuum chamber to the magnet cartridge. Disposed between the magnet cartridge and the outer vacuum chamber is a radiation shield, through which the support members extend.

To facilitate the superconductivity of the electrical wiring within the magnet cartridge, the magnet cartridge is maintained at a temperature that approaches absolute zero. However, the walls of the outer vacuum chamber are subject to ambient (room) temperature. To maintain this large temperature gradient, the magnet assembly is designed to reduce convection, radiation, and conduction heat transfer between the magnet cartridge and the walls of the outer vacuum chamber.

A reduction in convection heat transfer is accomplished by maintaining a vacuum within the outer vacuum chamber. A reduction in radiation heat transfer is accomplished by the radiation shield, and a reduction of conductive heat transfer is accomplished through the design of the support members.

The support members are subjected to the large temperature gradient—with the end of the support member at the magnet cartridge subjected to temperatures approaching absolute zero, and the end of the support member at the outer vacuum chamber subjected to room temperature. The support members are designed to have very low thermal conductivity and to cater for the effects of differences in the coefficient of thermal expansion of the different materials used in the construction of the magnet and the suspension system. In addition to the thermal stresses, the support members must be designed to withstand forces applied by the magnet. These forces include the weight mass of the magnet, which can be many tons, and the forces induced by the magnet, which can be even greater. The support members must have sufficient stiffness to prevent motion of the magnet when these forces are applied.

Typically, the support members are long, thin rods. Because the rods are long and thin, the heat transfer area is small, which is an advantage in preventing conductive heat transfer. However, these rods provide support in tension only and would buckle if exposed to a compressive load while the forces applied to the support members by the magnet are not constant in direction. Thus, to ensure that the magnet cartridge is supported under the varying forces, the rods are arranged in a matrix surrounding the magnet cartridge.

While such support members are effective in supporting the magnet cartridge, the use of such support members has drawbacks. First, as the number of rods used in the array increases, the conductive heat transfer area also increases. In addition, the number of penetrations through the radiation shield also increases, which decreases the effectiveness of the radiation shield, and increases the labor necessary to seal each of the penetrations from radiation leakage. Second, the rods must be accurately positioned (e.g., in diametrically opposed fashion) and are typically pre-tensioned. The accurate positioning of the rods and the pre-tensioning of the rods add to the cost of manufacturing the magnet assembly.

SUMMARY OF INVENTION

The above-described drawbacks and deficiencies are overcome or alleviated by a superconducting magnet assembly wherein the magnet cartridge is suspended within the vacuum chamber by a single support member extending from a wall of the vacuum chamber to the magnet cartridge. In one aspect, the support member includes a support tube and a joint attached to an end of the support tube. The joint is attached to the wall of the outer vacuum chamber, and provides at least one degree of freedom to the support tube relative to the wall. In another aspect, a joint is attached to an opposite end of the support tube, and is attached to the magnet cartridge for providing at least one degree of freedom to the support tube relative to the magnet cartridge. In another aspect, the support is constructed from one or more sections and the material choice is governed by the requirements for strength, stiffness, and thermal conductivity.

The above discussed and other features and advantages of the present invention will be appreciated and understood by those skilled in the art from the following detailed description and drawings.

BRIEF DESCRIPTION OF DRAWINGS

Referring to the exemplary drawings wherein like elements are numbered alike in the several Figures.

DETAILED DESCRIPTION

Figure 1:
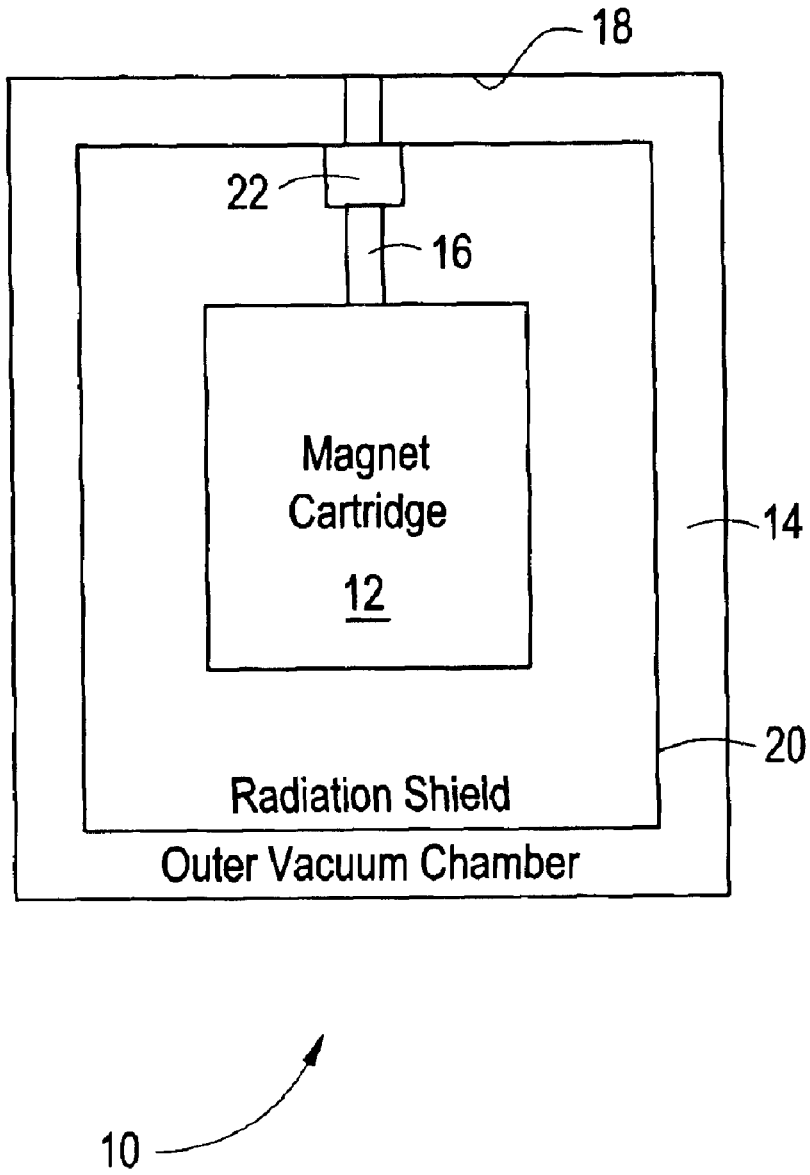
FIG. 1 is a schematic diagram of a superconducting magnet assembly.

Referring to FIG. 1, a superconducting magnet assembly 10 is shown. Superconducting magnet assembly includes a magnet cartridge 12 suspended within an outer vacuum chamber 14 by a single support member 16. Disposed between magnet cartridge 12 and a wall 18 of outer vacuum chamber 14 is a radiation shield 20, through which support member 16 extends. A thermal coupling 22 extends between support member 16 and radiation shield 20. Support member 16 is fixedly secured to wall 18 and magnet cartridge 12 such that support member 16 transmits axially compressive and tensile loads from magnet cartridge 12 to wall 18.

During operation, magnet cartridge 12 is maintained at a low temperature (e.g., near absolute zero), while the wall 18 of outer vacuum chamber is subject to the temperature of the room in which superconducting magnet assembly 10 is placed. Thus, during operation a temperature differential exists along support member 16.

Figure 2:
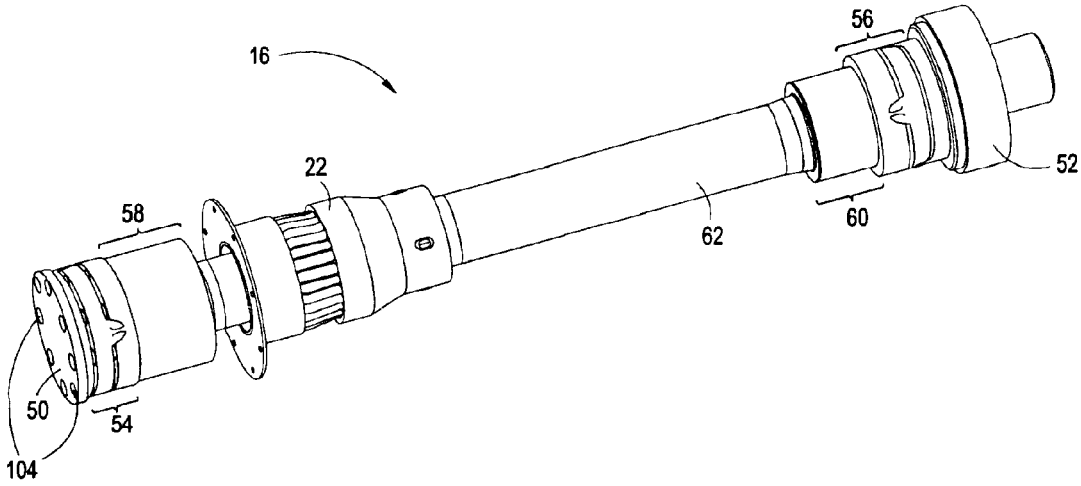
FIG. 2 is an isometric view of a support member for the superconducting magnet assembly of FIG. 1.

Referring to FIG. 2, an isometric view of support member 16 is shown. Support member 16 has an outer vacuum chamber end 50 and a magnet cartridge end 52. Disposed on ends 50 and 52 are joints 54 and 56 and tube couplings 58 and 60. Extending between tube couplings 58 and 60 is a support tube 62. Attached to a central portion of support tube 62 is thermal coupling 22.

When support member 16 is installed, ends 50 and 52 are secured against wall 18 and magnet cartridge 12, respectively. Tensile and compressive forces are transmitted from magnet cartridge 12, through joint 56 and tube coupling 58 to support tube 62, and from support tube 62 through tube coupling 56 and joint 54 to wall 18. As will be discussed in further detail hereinafter, each of joints 54 and 56 are very stiff axially, but allow support tube 62 to pivot through small angles. The joints 54 and 56 compensate for manufacturing tolerances, build errors, and the effect of differential thermal expansion, and translate pure axial tension and compression forces on the support tube 62.

Figure 3:
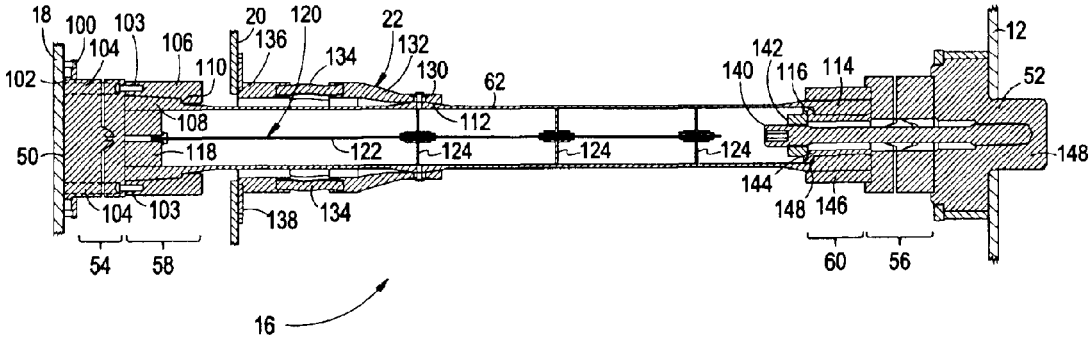
FIG. 3 is a cross-sectional view of the support member of FIG. 2.

Referring to FIG. 3, a cross-sectional view of support member 16 is shown. End 50 of support member is secured against wall 18 by a flange 100, which captures a circumferential ridge 102 formed on joint 54. Flange 100 is secured to wall 18 by welding, bolting, or the like. Joint 54 is secured to tube coupling 58 by a plurality of bolts 103, which are recessed in joint 54 by way of through holes 104 in joint 54. Bolts 103 engage a collar 106, which is disposed around the periphery of support tube 62. While an exemplary embodiment is described herein, it will be appreciated that end 50 and 52 may be secured against wall 18 and magnet cartridge 12, respectively, using any suitable means.

In the embodiment shown, support tube 62 is an elongated cylinder of generally uniform thickness having regions of increased thickness. A first region of increased thickness 108 is formed near end 50, where the outside diameter of support tube 62 is increased abruptly such that a diametrical ridge 110 is formed. From the ridge 110 to the end of the tube 62, the outside diameter is increased gradually to create taper. A second region of increased thickness 112 is formed near the center of support tube 62, where the outside diameter of the support tube is increased. The second region of increased thickness 112 provides support for the thermal coupling 22. The third region of increased thickness 114 is formed near end 52, where the inside diameter is decreased abruptly such that a diametrical ridge 116 is formed. From the ridge 116 to the end of the tube 62, the inside diameter is decreased gradually to create taper.

Support tube 62 may be constructed of any thermally insulative material such as, for example, fiberglass, carbon (graphite) fiber, plastic, or the like. Support tube 62 may also be a composite structure, including more than one material. Where a support tube 62 is a composite structure, the materials are selected based on the performance of the material at the temperatures applied to the different portions of the support tube 62. For example, the portion of support tube 62 extending from the second region of increased thickness 112 toward end 50 may be constructed of a fiberglass material, which has good strength properties at temperatures around room temperature, and the portion of support tube 62 extending from the second region of increased thickness 112 toward the end 52 may be constructed of a carbon fiber material, which has good strength properties at temperatures approaching absolute zero.

Disposed within the support tube 62 at the first region of increased thickness 108 is a cylindrical plug 118. Cylindrical plug 118 and collar 106 form the tube coupling 58, which secures the support tube 62 to the joint 54. An inside diameter of collar 106 is tapered to match the taper at the first region of increased thickness 108. The taper of the collar acts to provide a compressive force onto the first region of increased thickness 108 as the collar 106 is drawn towards the joint 54 by the tightening of screws 103. The plug 118 acts to support the inside of the support tube 62 against the compressive force of the collar 106. The inside diameter of the collar 106 includes a ridge, which interacts with the diametrical ridge 110 on the support tube 62. Together, the collar 106 and plug 118 secure the end of the support tube 62 against the joint 54 when the support tube 62 is under an axially tensile load. Plug 118 and collar 106 may be manufactured from a rigid material such as, for example, stainless steel or titanium.

Disposed within support tube 62 is a thermal baffle assembly 120. The thermal baffle assembly 120 includes a support rod 122 that is secured at one end to plug 118, and extends along the longitudinal axis of the tube 62. Secured to support rod 122 is a series of spaced-apart disks 124. The disks 124 act as baffles to intercept heat radiation through the tube 62. The disks 124 and support rod 122 may be constructed of a thermally insulative material such as, for example, plastic, fiberglass, aluminized Mylar or carbon fiber.

Attached to the support tube 62 at the second region of increased thickness 112 is the thermal coupling 22. A cylindrical portion of thermal coupling 130 is disposed around support tube 62 and attached thereto by fasteners, adhesive, or the like. Extending from cylindrical portion 130 towards end 50 is a conical portion 132. A plurality of thermally conductive braids 134 extend from an end of conical portion 132 towards end 50, and a second cylindrical portion 136 is, in turn, coupled to the ends of the braids 134. Extending radially from an end of second cylindrical portion 136 distal from the braids 134 is a flange 138. Flange 138 is coupled to the radiation shield 20 using, for example, fasteners, adhesive, welding, or the like. Thermal coupling 22 may be constructed of a thermally conductive material, such as copper.

Thermal coupling 22 acts to shunt the conduction of heat from the outer vacuum chamber wall 18 to the radiation shield 20, and thereby prevent the conduction of heat to the magnet cartridge 12 via the support member 16. Braids 134 prevent vibration of the radiation shield 20 from traveling to the magnet cartridge 12 via the support member 16, and also prevent the forces applied to the support member 16 from being transmitted to the radiation shield 20.

The third region of increased thickness 114 on the support tube 62 is captured by the tube coupling 60. Tube coupling 60 comprises a bolt 140, a washer 142, a plug 144, and a sleeve 146. The bolt 140 extends along the longitudinal axis of the support member 16, through the washer 142, plug 144, and joint 56, and threadably engages an end cap 148. An outside diameter of the plug 144 is tapered to match the taper at the third region of increased thickness 144. The taper of the plug 144 acts to provide a compressive force onto the inside diameter of the third region of increased thickness 114 as the plug 144 is drawn towards the joint 56 by the tightening of bolt 140. The collar 146 acts to support the outside of the support tube 62 against the compressive force of the plug 144. The outside diameter of the plug 144 includes a ridge 148, which interacts with the diametrical ridge on the inside diameter of the support tube 62. Together, the collar 146 and plug 144 secure the end of the support tube 62 against the joint 56 when the support tube 62 is under an axially tensile load. Plug 144, bolt 140, washer 142, and collar 146 may be manufactured from a rigid, non-magnetic material such as, for example, titanium.

End cap 148 is secured to the magnet cartridge 12 by way of fastener, welding, adhesive, or the like. Joint 56 is captured between tube coupling 60 and end cap 148 when bolt 140, which is threaded into end cap 148, is tightened.

Figure 4:
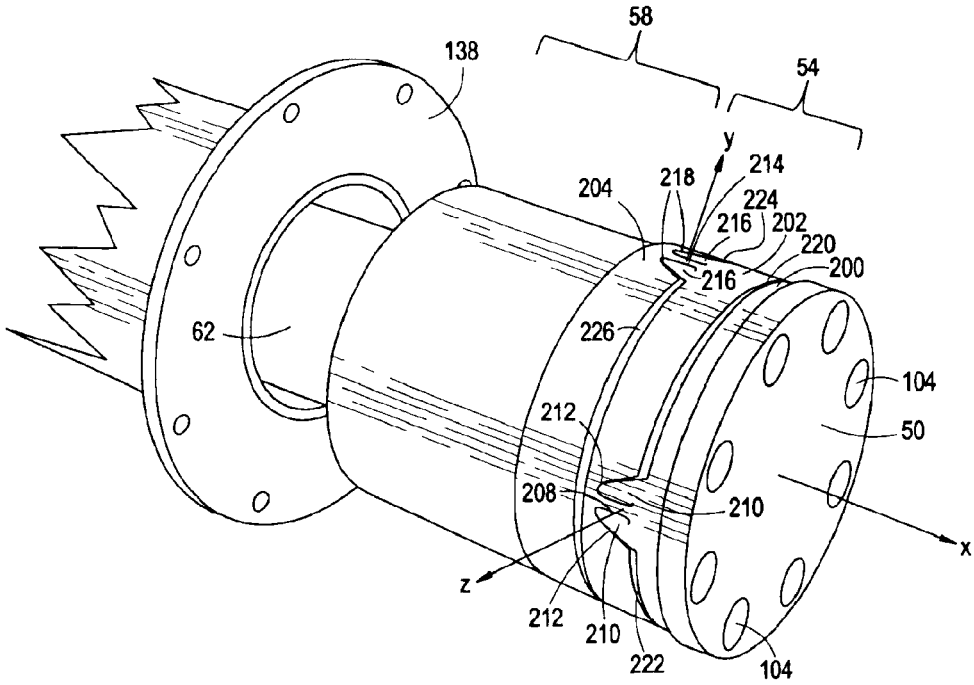
FIG. 4 is an isometric view of an end joint on the outer vacuum chamber side of the support member of FIG. 2.
Figure 5:
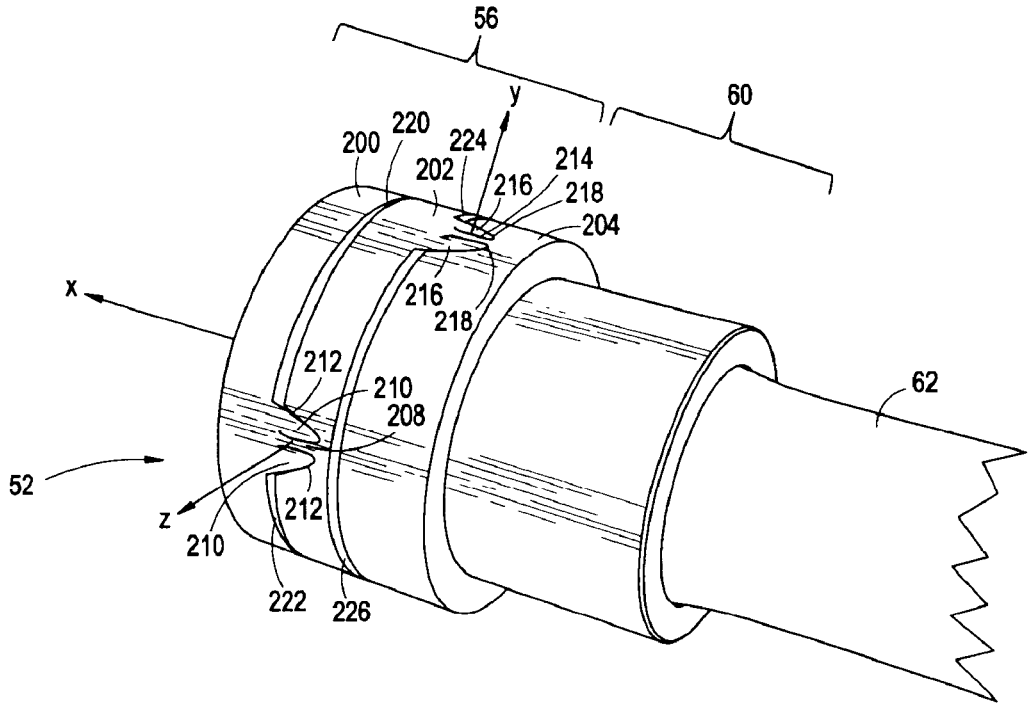
FIG. 5 is an isometric view of an end joint on the magnet cartridge side of the support member of FIG. 2.

Referring now to FIGS. 4 and 5, the construction of joints 54 and 56 will be described. Each joint 54 and 56 includes first, second, and third disks 200, 202 and 204. The first disk 200 is coupled to the second disk 202 by a beam 208, which extends along a diameter of the first disk 200. The first disk 200 includes wedges 210 extending therefrom along either side of the beam 208. The wedges 210 are received within recesses 212 formed in the second disk 202. Similarly, the second disk 202 is coupled to the third disk 204 by a beam 214, which extends along the diameter of the second disk 202. The second disk 202 includes wedges 216 extending therefrom along either side of the beam 214. The wedges 216 are received within recesses 218 formed in the third disk 204. In the embodiment shown, each joint 54 and 56 is machined from a solid cylinder of rigid, non-magnetic metal, such as titanium or Inconnel. Two diametrically opposed slots 220 and 222 disposed in the cylinder form the space between each disk 200 and 202, each beam 208, two wedges 210, and two recesses 212.

Similarly, two diametrically opposed slots 224 and 226 disposed in the cylinder form the space between each disk 202 and 204, each beam 214, two wedges 216, and two recesses 218.

The bending of beams 208 and 214 provides two degrees of freedom to each joint 54 and 56. Thus, while each joint 54 and 56 is very stiff axially, they allow support tube 62 to pivot through small angles about the y and z axes indicated in FIG. 4 and FIG. 5. The y and z axes may be situated at 90 degrees to each other and at 90 degrees to the centroidal axis x of the support member 16. The joints 54 and 56 compensate for manufacturing tolerances, build errors and the effect of differential thermal expansion and translate the forces applied by magnet cartridge 12 into pure axial tension and compression forces on the support tube 62. The wedges 210 and 216 provide lateral support to beams 208 and 214 thereby preventing the buckling of beams 208 and 214. In addition, the wedges 210 and 216 help to stiffen the disk between the two beams.

The single support member 16 takes all loads in tension and compression that a typical design would handle with a combination of tension straps. Thus, the support member 16 reduces the number of rods typically used in supporting the magnet cartridge 12, and, thereby reduces the conductive heat transfer area from that previously possible. In addition, the number of penetrations through the radiation shield 20 also decreases from designs that use a combination of tension straps. This, in turn, increases the effectiveness of the radiation shield 20 and requires less labor to seal penetrations in the radiation shield 20 from that previously possible. The high stiffness joints 54 and 56 take up build errors and the effect of differential thermal expansion and translate them into pure axial tension and compression forces on the support tube 62.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. A superconducting magnet assembly comprising:

a vacuum chamber having a wall;

a magnet cartridge; and a single support member extending from a wall of said vacuum chamber to said magnet cartridge, said single support member suspending said magnet cartridge within said vacuum chamber.

2. The superconducting magnet assembly of claim 1, wherein said single support member includes:

a support tube; and a joint attached to an end of said support tube, said joint being attached to said wall of said outer vacuum chamber, said joint providing at least one degree of freedom to said support tube relative to said wall.

3. The superconducting magnet assembly of claim 2, wherein said joint includes first, second, and third disks, said first disk is coupled to said second disk by a first beam extending along at least a portion of a diameter of said first disk, and said second disk is coupled to said third disk by a beam extending along at least a portion of a diameter of said second disk.

4. The superconducting magnet assembly of claim 3, wherein said first disk includes first wedges extending therefrom along either side of said first beam, said first wedges are received within first recesses formed in said second disk, and said second disk includes second wedges extending therefrom along either side of said second beam, said second wedges are received within second recesses formed in said second disk.

5. The superconducting magnet assembly of claim 4, wherein said joint is machined from a solid cylinder of material.

6. The superconducting magnet assembly of claim 1, wherein said single support member includes:

a support tube; and a joint attached to an end of said support tube, said joint being attached to said magnet cartridge, said joint providing at least one degree of freedom to said support tube relative to said magnet cartridge.

7. The superconducting magnet assembly of claim 6, wherein said joint includes first, second, and third disks, said first disk is coupled to said second disk by a first beam extending along at least a portion of a diameter of said first disk, and said second disk is coupled to said third disk by a beam extending along at least a portion of a diameter of said second disk.

8. The superconducting magnet assembly of claim 7, wherein said first disk includes first wedges extending therefrom along either side of said first beam, said first wedges are received within first recesses formed in said second disk, and said second disk includes second wedges extending therefrom along either side of said second beam, said second wedges are received within second recesses formed in said second disk.

9. The superconducting magnet assembly of claim 8, wherein said joint is machined from a solid cylinder of material.

10. The superconducting magnet assembly of claim 1, wherein said single support member includes:

a support tube; and a baffle disposed within said support tube.

11. A support member for suspending a magnet cartridge within an outer vacuum chamber in a superconducting magnet assembly, said support member comprising:

a support tube; and a joint attached to an end of said support tube, said joint being attached to a wall of said outer vacuum chamber, said joint providing at least one degree of freedom to said support tube relative to said wall.

12. The superconducting magnet assembly of claim 11, wherein said joint includes first, second, and third disks, said first disk is coupled to said second disk by a first beam extending along at least a portion of a diameter of said first disk, and said second disk is coupled to said third disk by a beam extending along at least a portion of a diameter of said second disk.

13. The superconducting magnet assembly of claim 12, wherein said first disk includes first wedges extending therefrom along either side of said first beam, said first wedges are received within first recesses formed in said second disk, and said second disk includes second wedges extending therefrom along either side of said second beam, said second wedges are received within second recesses formed in said second disk.

14. The superconducting magnet assembly of claim 13, wherein said joint is machined from a solid cylinder of material.

15. The superconducting magnet assembly of claim 11, wherein said single support member includes:

a support tube; and a joint attached to an end of said support tube, said joint being attached to said magnet cartridge, said joint providing at least one degree of freedom to said support tube relative to said magnet cartridge.

16. The superconducting magnet assembly of claim 15, wherein said joint includes first, second, and third disks, said first disk is coupled to said second disk by a first beam extending along at least a portion of a diameter of said first disk, and said second disk is coupled to said third disk by a beam extending along at least a portion of a diameter of said second disk.

17. The superconducting magnet assembly of claim 16, wherein said first disk includes first wedges extending therefrom along either side of said first beam, said first wedges are received within first recesses formed in said second disk, and said second disk includes second wedges extending therefrom along either side of said second beam, said second wedges are received within second recesses formed in said second disk.

18. The superconducting magnet assembly of claim 17, wherein said joint is machined from a solid cylinder of material.

19. The superconducting magnet assembly of claim 11, wherein said single support member includes:

a support tube; and a baffle disposed within said support tube.

20. A superconducting magnet assembly comprising:

a vacuum chamber having a wall;

a magnet cartridge; and a single support member extending from said wall of said vacuum chamber to said magnet cartridge, said single support member suspending said magnet cartridge within said vacuum chamber, said single support member includes:

a support tube, a first joint attached to an end of said support tube, said first joint being attached to a wall of said outer vacuum chamber, said first joint providing at least one degree of freedom to said support tube relative to said wall, and a second joint attached to an opposite end of said support tube, said second joint being attached to said magnet cartridge, said second joint providing at least one degree of freedom to said support tube relative to said magnet cartridge.

21. A superconducting magnet assembly comprising:

a vacuum chamber having a wall;

a magnet cartridge; and a single support member extending from a wall of said vacuum chamber to said magnet cartridge, said single support member suspending said magnet cartridge within said vacuum chamber, said single support member includes:

a support tube, a first means for providing at least one degree of freedom to said support tube relative to said wall, and a second means for providing at least one degree of freedom to said support tube relative to said magnet cartridge.

22. The superconducting magnet assembly of claim 21, wherein said first means is coupled to said support tube by a first tube coupling means, and said second means is coupled to said support tube by a second tube coupling means.

23. The superconducting magnet assembly of claim 22, wherein said first and second tube coupling means each include a plug disposed within said support tube and a collar disposed around a periphery of said support tube.

24. The superconducting magnet assembly of claim 21, wherein said first and second means each includes first, second, and third disks, said first disk is coupled to said second disk by a first beam extending along at least a portion of a diameter of said first disk, and said second disk is coupled to said third disk by a beam extending along at least a portion of a diameter of said second disk.

25. A method of suspending a magnet cartridge within an outer vacuum chamber in a superconducting magnet assembly, the method comprising:

securing the superconducting magnet assembly to a single support member, said single support member including at least one joint disposed on a support rod.

* * * * *